United States Patent [19]

Hernandez

[11] Patent Number: 4,681,217

[45] Date of Patent: Jul. 21, 1987

[54] WRAP-AROUND CARRIER WITH IMPROVED HANDLE

[75] Inventor: Kenneth J. Hernandez, Monroe, La.

[73] Assignee: Manville Corporation, Denver, Colo.

[21] Appl. No.: 919,735

[22] Filed: Oct. 16, 1986

[51] Int. Cl.[4] ..... B65D 5/46

[52] U.S. Cl. ..... 206/141; 206/427; 206/434

[58] Field of Search ..... 206/141, 167, 199, 200, 206/427, 434; 229/52 B, 52 BC

[56] References Cited

U.S. PATENT DOCUMENTS

| | | | |
|---|---|---|---|
| 3,353,709 | 11/1967 | Lawrence | 206/141 |
| 4,222,485 | 9/1980 | Tocke | 206/141 |
| 4,375,258 | 3/1983 | Crayne et al. | 206/141 |
| 4,424,901 | 1/1984 | Lanier | 206/141 |
| 4,470,503 | 9/1984 | Stone | 206/141 |
| 4,558,816 | 12/1985 | Wood | 206/141 |

*Primary Examiner*—Joseph Man-Fu Moy

*Attorney, Agent, or Firm*—John D. Lister; Cornelius P. Quinn; Timothy R. Schulte

[57] ABSTRACT

A wrap-around article carrier with a handle portion bounded by space slits extending across the width of the top panel. The fingers and thumb are intended to be inserted into cutouts covered by tabs the outer boundaries of which comprise part of the slits. The fingers can then extend under the handle portion so as to use it as a strap. The width of the tabs is half the distance between the fold lines attaching the tabs to the handle portion so that the tabs meet beneath the handle portion to form a layer of double thickness. The handle portion is further provided with score lines, four of them being arranged so that the surfaces connected to them fold downwardly about them. The surfaces connected to the fifth fold line, which is centrally located and which extends in the direction of the handle, fold upwardly about it. This arrangement directs the lifting stresses outwardly to the side panels.

11 Claims, 3 Drawing Figures

WRAP-AROUND CARRIER WITH IMPROVED HANDLE

FIELD OF THE INVENTION

This invention relates to a wrap-around article carrier, and more particularly to a wrap-around article carrier having an improved handle portion which has greater strength than the finger grips normally used in such carriers.

BACKGROUND OF THE INVENTION

One type of carrier for articles such as bottles and cans is formed from a blank of paperboard sheet stock which is wrapped around the articles by a packaging machine. Typically, the carrier consists of two side panels foldably connected to top and bottom panels, leaving the ends of the carrier open. The package is adapted to be lifted by the thumb and finger through finger holes in the top panel. Openings in the side panels adjacent the bottom panel hold the heels or bases of the articles in place. When the articles packaged are bottles, openings in the top panel allow the necks of the bottles to protrude through to hold them in place.

One problem with such carriers is their vulnerability to tearing at the finger grips when the package is lifted by the thumb and finger due to concentration of stresses at these points. To combat this the carriers typically are formed from relatively thick paperboard, having a caliper of 23 to 25 points (0.023"–0.025"). Although this material provides adequate tear resistance, it is recognized that if it were not for the tear stresses at the finger grips, thinner paperboard could be used. This would of course be a more economical construction and would be desirable to use if the problem of resisting construction and would be desirable to use if the problem of resisting tear stresses at the finger grips could be solved by other means.

In addition, although the design described above has been in use for quite some time many people would prefer not to lift a package of this size and weight by only their thumb and finger. Carrying a package with this grip can be tiring over a period of time and is simply not as comfortable as using one's entire hand. For this reason also it would be desirable to have a stronger, more convenient handle design for lifting and carrying a wrap-around carrier.

BRIEF SUMMARY OF THE INVENTION

This invention provides an improved handle design which solves the problems mentioned above. The top panel of the carrier contains two slits extending transversely of the length of the carrier, that is, transversely of the folds connecting the side panels to the top panel, to form a handle strap therebetween. Although various forms of handle straps have been used in the past, the arrangement of the present invention represents a distinct improvement. Tabs extending outwardly from the slits toward the ends of the carrier are adapted to be folded downwardly and up against the underside of the handle so that together they extend across substantially the entire width of the underside of the handle. This arrangement reinforces the handle and allows the user to lift the carrier with either hand. In addition, the handle is provided with a unique reinforcing fold arrangement for diverting the lifting stresses to the sides of the package.

These design features can readily be implemented in the standard type of production blank from which the carrier is formed, requiring only minor modifications to the blank forming die to provide for new slit and score lines.

Other features and aspects of the invention, as well as its various benefits, will be made more clear in the detailed description of the preferred embodiment which follows.

DESCRIPTION OF THE INVENTION

Figure 1:
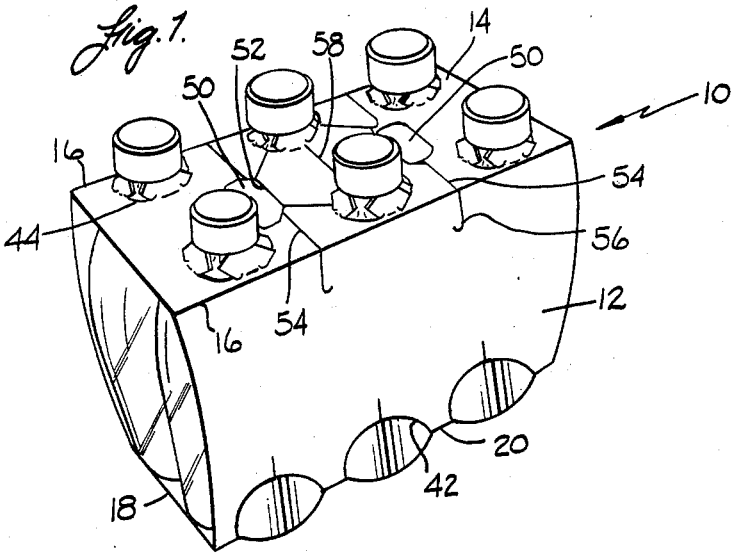
FIG. 1 is a pictorial representation of a wrap-around carrier of the present invention, shown containing six bottles, as it would appear prior to being picked up by a user.
Figure 3:
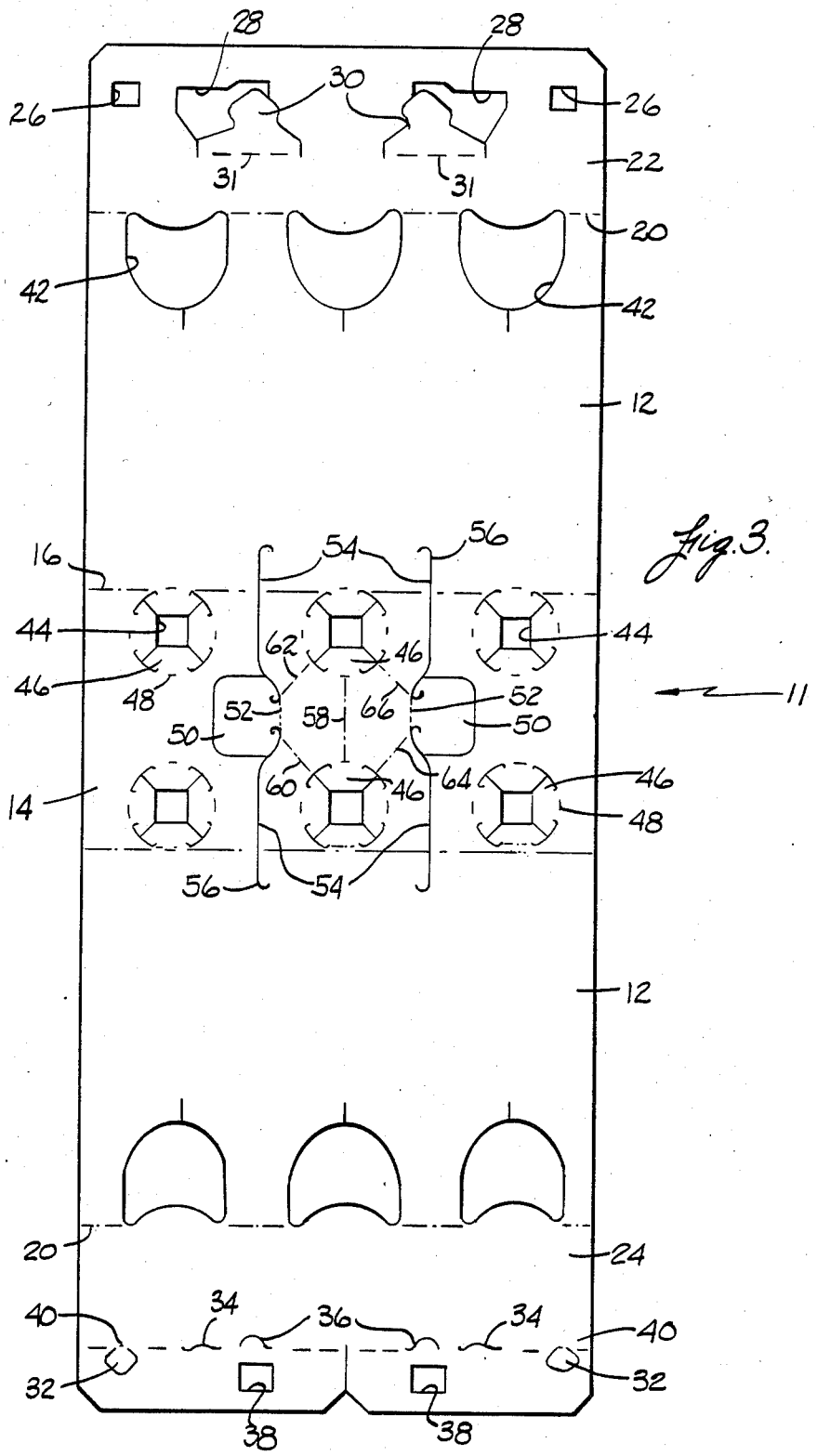
FIG. 3 is a plan view of a carrier blank for forming the carrier of the present invention.

Referring to FIG. 1, wrap-around carrier 10 comprises side panels 12 foldably connected to top panel 14 by folds 16 and to bottom panel 18 by folds 20. As shown in FIG. 3, the carrier is formed from a single blank 11 whose intermediate sections 12 and central section 14 correspond to side panels 12 and top panel 14 of the carrier of FIG. 1. Score lines 16 of the blank correspond to folds 16 of the carrier, and score lines 20 of the blank correspond to folds 20 of the carrier.

The bottom panel 18 of the carrier is formed from blank end sections 22 and 24. The end section 22 is shown to contain cutouts 26 and 28 and to have tabs 30 hingedly connected by score or fold lines 31 adjacent the cutouts 28. The other end section 24 includes tabs 32, 34 and 36, and further contains cutouts 38. Tabs 32 are hingedly connected to the end section by score or fold lines 40.

In forming the carrier the blank is folded downwardly on all score lines, as viewed in FIG. 3, so that end section 22 overlaps end section 24. End sections 22 and 24 are mechanically interlocked by the insertion of tabs 30 into cutouts 38, tabs 32 into cutouts 26 and tabs 34 and 36 into cutouts 28. These operations are all carried out by the automatic packaging machine designed to handle the particular type of blank being used and do not form a part of the present invention. Although the locking mechanism described results in a highly satisfactory bottom panel construction, enabling the bottom panel to be selectively locked in place by one or more of the tab and cutout mechanisms in order to accommodate different package perimeters, any arrangement for suitably forming a bottom panel from the end sections of a blank may be used. This invention, therefore, is not limited to any particular bottom panel design.

Still referring to FIGS. 1 and 3, cutouts 42, located adjacent score lines 20 in intermediate sections 12 of the blank 11, correspond to openings 42 in the side panels 12 of the carrier 10 through which the heels or bases of the bottles protrude. This common arrangement allows for slight variations in the final package dimensions and serves to hold the bases of the bottles in place. In addition, cutouts 44, located in central section 14 of the blank 11, correspond to openings 44 in the top panel 14 of the carrier 10 through which the necks of the bottles extend. Tabs 46, adapted to be bent upwardly about score lines 48, surround the neck holes 44 to complete the neck retainer structure. Although shown in some detail, the carrier construction described thus far is basically conventional in the art.

Spaced apart a distance to enable easy grasping by the thumb and middle finger are tabs 50, located in central section 14 of the blank 11 and in the top panel 14 of the carrier 10. The tabs 50 can be either totally separated from the top panel or attached to it by spaced narrow segments of paperboard which are allowed to remain uncut but which are readily broken by the user's thumb or fingers. In either case, as shown in FIGS. 1 and 3, the tabs are connected to the carrier by fold lines 52 which typically are interrupted cuts. This construction allows the tabs to pivot down about the fold lines in the manner of a hinge.

Extending transversely from each side of the tabs 50 toward the nearest fold line 16 are slits 54 which terminate in the upper portion of the side panels 12 a short distance from the folds 16. The portions of the slits 54 located in the side panels are provided with a short arcuate length 56 which causes the ends of the slits to be directed back in the general direction of the top panel. This construction reduces the tendency of the stresses caused by lifting to tear the side panels. The slits 54 and the portions of the tabs 50 adapted to be separated from the top panel 14 in effect form continuous slits extending across the full width of the top panel and into the top portion of the side panels. As will be seen, the portion of the top panel between such continuous slits becomes the handle of the carrier, allowing all four fingers of the hand to be inserted beneath either such continuous slit and the thumb to be inserted in the opposite thumb or finger hole.

Within the handle portion or strap thus formed a score line 58 extends between opposite tabs 46 of the bottle neck retainers that are located in the handle portion. In addition, score line 60 extends from one end of the fold line 52 of the tab 50 shown at the left side of FIG. 3 to the intersection of the closest adjacent tabs 46 of the nearest bottle neck retainer 44 in the handle portion. Similarly, score line 62 extends from the other end of the same fold line to the intersection of the nearest adjacent tabs 46 of the bottle neck retainer closest to that end of the fold line. In like manner, score lines 64 and 66 extend from the ends of the fold line 52 of the other tab 50 to the intersection of the closest adjacent tabs of each of the same bottle neck retainers. The purpose of the score lines is to enable the handle portion to bend upwardly about score line 58 and downwardly about score lines 60, 62, 64, and 66 to thus strengthen the handle and disperse the lifting stresses to the sides of the carrier instead of requiring only the handle itself to take the full brunt of the lifting stresses.

Figure 2:
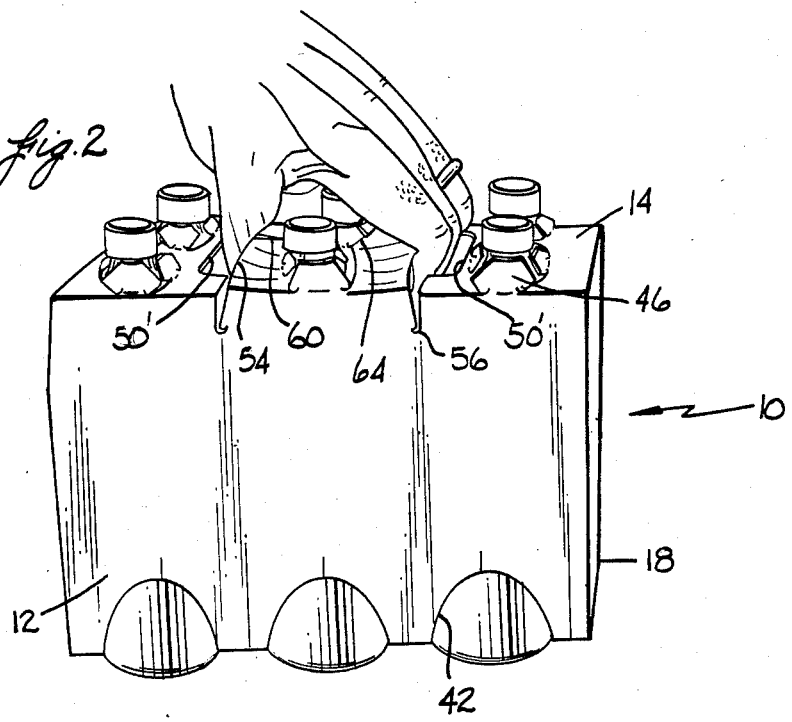
FIG. 2 is a pictorial representation of the carrier of FIG. 1 after it has been lifted.

Referring to FIGS. 1 and 2, the user will push down on tabs 50 with the thumb and finger, bending them down about their score lines 52. The resulting cutouts 50', which had been covered by the tabs 50, are the same shape as the tabs and are easily large enough to receive the thumb and finger. The tabs fold in toward each other until they are bent back up against the underside of the handle portion. This makes a double thick layer in this area which strengthens the handle portion and also provides a cushion for the thumb and finger. As shown in FIG. 3, the width of the tabs 50 is equal to half the distance between the fold lines 52, so that when the tabs are folded under their ends will substantially meet, thus providing an area of double thickness across the entire width of the central portion of the handle.

At this point all the fingers can be inserted beneath the slit formed by the slits 54 and the adjacent opening 50' occupied initially by the user's finger, and the package can be lifted by the thumb and the fingers. The package at this point assumes the shape shown in FIG. 2, whereby the portions of the handle bounded by score lines 58, 60 and 62 and by score lines 58, 64 and 66 are folded upwardly about score line 58. At the same time the score lines 60, 62, 64 and 66 are lifted up by the tension produced by lifting the package so that the surfaces connected to these score lines are folded downwardly about them. The result is that the handle portion is raised up from the top panel to form a strap handle under which the thumb and fingers can extend. Significant amounts of the lifting stresses induced in the carrier are thereby transmitted to the side panels, the score lines 58, 60, 62, 64 and 66 strengthening the handle to enable the stress transmission to occur.

While the specific dimensions of the handle components may vary as desired, the size and number of containers or articles inside the carrier will of course have a bearing on the dimensional relationships used. With a six bottle carrier of the type shown in the drawings it has been found desirable to employ a handle strap of generally hour glass configuration. In other words, the distance between the slits 54 would be greater than the distance between the tab fold lines 52. This arrangement makes it possible to dimension the tabs 50 so that they meet when folded under to form the layer of double thickness across the full width of the handle. If the width of the handle at the finger holes were not reduced it would be impractical in some designs to provide for a layer of double thickness because the tabs 50 would have to extend too close to the outer bottle cutouts 44. If the distance between the tab cutout 50' and the outer bottle cutouts 44 is too small, this strip of material would be another potential tear point and would be counter to the purpose of the invention.

As will now be appreciated, the handle portion of the present invention has been greatly improved from the point of view of the consumer, who can now grasp and lift the package with the whole hand instead of just by the thumb and finger. It has also been greatly improved from the point of view of the producer who by merely redesigning the cut and score marks on the blank forming die can produce a carrier of such improved strength that it permits thinner, more economical paperboard to be used. For example, whereas paperboard having a caliper of 23 to 25 points has commonly been used in prior art wrap-around carriers, paperboard having a caliper of only 20 points can readily be used in the carrier of this invention. Moreover, the use of still thinner stock, such as down to a caliper of 18, is feasible.

It should be understood that the term "score line" as used herein refers to a rupturing of the surface of the blank sheet material, resulting in a depression one one side of the sheet and a welt on the other, which allows the sheet to fold about that line. It does not refer to a line which has been partially slit, which would weaken the fold and be unacceptable for the purpose of this invention.

It should be obvious that although a preferred embodiment of the invention has been described, changes to certain specific details of the embodiment can be made without departing from the spirit and scope of the invention defined in the claims.

What is claimed is:

1. A wrap-around article carrier, comprising:

a top panel;

a bottom panel;

side panels integral with and foldably connected to the top and bottom panels;

the top panel containing two tabs in the central portion thereof, the tabs being connected to the top panel along fold lines extending transversely of the folds connecting the side panels to the top panel;

the tabs being spaced from each other a distance enabling the thumb and finger of a user to push the tabs down, pivoting them out of the plane of the top panel about their fold lines;

the top panel also containing two slits extending across the width of the top panel and terminating in the side panels, the portion of the top panel between the slits comprising the handle portion of the carrier;

the central portion of each slit including the outer boundaries of one of the tabs; and the handle portion containing a score line intermediate the slits and extending transversely of the folds connecting the side panels to the top panel, the portions of the handle between the slits and the score line folding upwardly about the score line when the carrier is lifted by the handle portion.

2. A wrap-around carrier according to claim 1, wherein the distance between the tab fold lines is less than the distance between the slits.

3. A wrap-around carrier according to claim 1, wherein the handle portion contains a first bottle neck cutout adjacent the fold line connecting one of the side panels to the top panel and a second bottle neck cutout adjacent the fold line connecting the other side panel to the top panel, the score line in the handle portion extending between the bottle neck cutouts.

4. A wrap-around carrier according to claim 3, wherein the handle portion contains four additional score lines, two extending between one of the tabs and the first and second bottle neck cutouts and the other two extending between the other tab and the first and second bottle neck cutouts, the portions of the handle on opposite sides of and connected to each of the four additional score lines folding downwardly about their associated score line when the carrier is lifted by the handle portion.

5. A wrap-around article carrier according to claim 1, wherein the distance between the outer extremity of each tab and its fold line is substantially one-half the distance between the tab fold lines so that upon the tabs being folded down about their fold lines and moved up against the underside of the handle portion, the central area of the handle portion will be comprised of a double thickness of material.

6. A production blank adapted to be formed into a wrap-around article carrier, comprising:

sheet material in the general shape of a rectangle;

the sheet having a central section intended to become the top panel of the carrier, end sections adapted to be connected together to form the bottom panel of the carrier, and intermediate sections connected to the central and end sections by score lines and intended to become the side panels of the carrier;

the central section containing two tabs in the central portion thereof, the tabs being connected to the central section along fold lines extending transversely of the score lines connecting the central and intermediate sections;

the tabs being spaced from each other a distance enabling the thumb and finger of a person lifting a carrier formed from the production blank to push the tabs down, pivoting them out of the plane of the top panel of the carrier about their fold lines;

the central section also containing two slits extending across the width of the central section and terminating in the intermediate sections, the portion of the central section between the slits comprising the handle portion of the carrier;

the central portion of each slit including the outer boundaries of one of the tabs; and the handle portion containing a first bottle neck cutout adjacent the score line connecting one of the intermediate sections to the central section, a second bottle neck cutout adjacent the score line connecting, the other intermediate section to the central section, and a score line in the handle portion extending between the bottle neck cutouts, the portions of the handle between the slits and the score line in the handle portion being adapted to fold upwardly about the handle portion score line when a carrier formed from the blank is lifted by the handle portion.

7. A production blank according to claim 6, wherein the handle portion contains four additional score lines, two extending between one of the tabs and the first and second bottle neck cutouts and the other two extending between the other tab and the first and second bottle neck cutouts, the portions of the handle on opposite sides of and connected to each of the four additional score lines being adapted to fold downwardly about their associated score line when a carrier formed from the blank is lifted by the handle portion.

8. A wrap-around article carrier, comprising:

a top panel, a bottom panel, side panels integral with and foldably connected to the top and bottom panels, the top panel also containing two slits extending across the width of the top panel and terminating in the side panels, the portion of the top panel between the slits comprising the handle portion of the carrier, the handle portion containing a first score line in the central portion thereof intermediate the slits and extending transversely of the folds connecting the side panels to the top panel, the portions of the handle between the slits and the score line folding upwardly about the score line when the carrier is lifted by the handle portion, and the handle portion containing four additional score lines, two extending from the general vicinity of the ends of the first score line and converging toward each other to terminate in the central area of one of the slits, the two extending from the general vicinity of the ends of the first score line and converging toward each other to terminate in the central area of the other slit, the portions of the handle on opposite sides of and connected to each of the four additional score lines folding downwardly about their associated score line when the carrier is lifted by the handle portion.

9. A wrap-around carrier according to claim 8, wherein the portions of the slits in the side panels contain an arcuate portion at least one point of which is located below the end of the associated slit.

10. A wrap-around carrier according to claim 8, wherein the handle portion contains a first bottle neck cutout adjacent the fold lines connecting one of the side panels to the top panel and a second bottle neck cutout adjacent the fold line connecting the other side panel to the top panel, the first score line extending between the bottle neck cutouts.

11. A wrap-around carrier according to claim 10, wherein two of the four additional score lines extend from the first bottle neck cutout and the other two additional score lines extend from the second bottle neck cutout.

* * * * *